US009624610B2

(12) United States Patent
Kongo et al.

(10) Patent No.: US 9,624,610 B2
(45) Date of Patent: Apr. 18, 2017

(54) EMBROIDERY PATTERN PLACEMENT SYSTEM, EMBROIDERY PATTERN PLACEMENT DEVICE, METHOD OF PLACING EMBROIDERY PATTERN FOR EMBROIDERY PATTERN PLACEMENT DEVICE, AND SEWING MACHINE

(71) Applicant: Janome Sewing Machine Co., Ltd., Tokyo (JP)

(72) Inventors: Takeshi Kongo, Tokyo (JP); Kyoko Ishii, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 14/824,020

(22) Filed: Aug. 11, 2015

(65) Prior Publication Data

US 2016/0215423 A1 Jul. 28, 2016

(30) Foreign Application Priority Data

Jan. 23, 2015 (JP) ..... 2015-010856

(51) Int. Cl.

| | |
|---|---|
| ***D05B 19/12*** | (2006.01) |
| ***D05B 19/08*** | (2006.01) |
| ***D05C 5/06*** | (2006.01) |

(52) U.S. Cl.

CPC ..... *D05B 19/12* (2013.01); *D05B 19/08* (2013.01); *D05C 5/06* (2013.01)

(58) Field of Classification Search

CPC ..... D05B 19/02; D05B 19/08; D05B 19/085; D05B 19/10; D05B 19/105; D05C 19/02; D05C 9/04; D05C 9/06

(Continued)

(56) References Cited

U.S. PATENT DOCUMENTS 5,911,182 A * 6/1999 Uyama ..... D05B 19/085 112/102.5
6,167,822 B1 * 1/2001 Miyasako ..... D05B 19/006 112/102.5

(Continued)

FOREIGN PATENT DOCUMENTS

JP 08-155163 A 6/1996
JP 2004-141471 A 5/2004

*Primary Examiner* — Danny Worrell

(74) *Attorney, Agent, or Firm* — Nakanishi IP Associates, LLC

(57) ABSTRACT

Provided is an embroidery pattern placement system including: an image-taking unit configured to take an image with an embroidery frame and cloth to be embroidered included in an image taking range; an image analyzing unit configured to analyze to make correspondence between the information of the embroidery frame obtained by the embroidery frame information obtaining unit and the embroidery frame in the image; a display control unit configured to display the embroidery pattern obtained by the embroidery pattern obtaining unit and at least a part of the image taken by the image-taking unit in an overlapping manner at an identical scale; and an operation unit configured to accept an operation from a user; an embroidery placement editing unit configured to determine a position and orientation of the embroidery pattern relative to the embroidery frame according to a content of the operation to the operation unit.

10 Claims, 13 Drawing Sheets

(58) Field of Classification Search
USPC ..... 700/136–138; 112/102.5, 470.04, 470.06
See application file for complete search history.

(56) References Cited

U.S. PATENT DOCUMENTS

| | | | | |
|---|---|---|---|---|
| 6,256,551 | B1 * | 7/2001 | Muto | D05B 19/10 112/102.5 |
| 7,155,302 | B2 * | 12/2006 | Muto | D05B 19/08 700/138 |
| 7,392,755 | B2 * | 7/2008 | Kato | D05B 19/12 112/102.5 |
| 7,675,418 | B2 * | 3/2010 | Agarwal | G06Q 10/087 340/572.1 |
| 8,061,286 | B2 * | 11/2011 | Hirata | D05B 19/10 112/102.5 |
| 8,091,493 | B2 * | 1/2012 | Tokura | D05B 19/10 112/470.01 |
| 8,196,535 | B2 * | 6/2012 | Tokura | D05B 19/10 112/470.01 |
| 8,245,219 | B2 * | 8/2012 | Agarwal | G06F 8/65 717/168 |
| 8,301,292 | B2 * | 10/2012 | Tokura | D05B 19/16 112/470.03 |
| 8,463,420 | B2 * | 6/2013 | Tokura | D05C 13/02 112/475.19 |
| 8,527,083 | B2 * | 9/2013 | Tokura | D05B 19/10 112/102.5 |
| 8,539,892 | B2 * | 9/2013 | Tokura | D05B 19/12 112/102.5 |
| 8,539,893 | B2 * | 9/2013 | Tokura | D05B 19/12 112/102.5 |
| 8,584,607 | B2 * | 11/2013 | Tokura | D05B 19/12 112/102.5 |
| 8,594,829 | B2 * | 11/2013 | Tokura | D05B 19/12 112/102.5 |
| 8,594,830 | B2 * | 11/2013 | Tokura | D05B 19/08 700/137 |
| 8,612,046 | B2 * | 12/2013 | Tokura | D05B 19/10 112/475.19 |
| 8,738,173 | B2 * | 5/2014 | Tokura | D05C 5/04 700/138 |
| 8,763,541 | B2 * | 7/2014 | Tokura | D05C 5/06 112/102.5 |
| 8,869,721 | B2 * | 10/2014 | Suzuki | D05B 19/12 112/102.5 |
| 9,127,385 | B2 * | 9/2015 | Suzuki | D05B 19/12 |
| 2004/0083022 | A1 | 4/2004 | Akira et al. | |
| 2014/0230708 | A1 * | 8/2014 | Suzuki | D05C 5/00 112/102.5 |
| 2015/0259841 | A1 * | 9/2015 | Ihira | D05C 5/04 112/102.5 |

* cited by examiner

EMBROIDERY PATTERN PLACEMENT SYSTEM, EMBROIDERY PATTERN PLACEMENT DEVICE, METHOD OF PLACING EMBROIDERY PATTERN FOR EMBROIDERY PATTERN PLACEMENT DEVICE, AND SEWING MACHINE

CROSS REFERENCE TO RELATED APPLICATIONS

This application is based on and claims the benefit of priority to Japanese Patent Application No. 2015-010856 filed on Jan. 23, 2015, the contents of which are hereby incorporated by reference in their entirety.

BACKGROUND OF THE INVENTION

Field of the Invention

The present invention relates to an embroidery pattern placement system, an embroidery pattern placement device, a method of placing an embroidery pattern for the embroidery pattern placement device, and a sewing machine.

Background Art

When making embroidery on cloth, it is a rare case to make embroidery on plain or unworked cloth. In most cases, embroidery is made to a part such as a pocket or a sleeve, or an embroidery pattern is formed on cloth already having decorative stitches or printed cloth.

Patent document 1 discloses a sewing machine capable of sewing after evenly placing a plurality of patterns, such as letters and the like, selected by a user in a specified stitch range of cloth to be embroidered attached to an embroidery frame.

With such a conventional sewing machine, the user attaches an embroidery frame to which cloth to be embroidered is set to the sewing machine, moves the embroidery frame to a position at which an intended embroidery pattern is to be made using a jogging operation as a function of the sewing machine, and moves a position of a needle to a position near a starting point. Then, the user executes a stitch range confirmation function, moves the embroidery frame relative to the needle along a line of a rectangle of a range in which the pattern is embroidered, and visually confirms that the pattern is contained within the rectangle. The position and the range of embroidery confirmed by this function can be roughly confirmed before execution of the embroidery. However, it is not possible to make a positional relation between a pattern of the cloth to be embroidered in the background and the embroidery pattern clear.

Further, it is necessary to make visual confirmation avoiding a mechanical section of the sewing machine when positioning an embroidery starting position of the cloth to be embroidered under the needle, and therefore it is difficult to perform correct positioning.

On the other hand, there has conventionally been known a technique for connecting a sewing machine and a personal computer or the like via wireless communication (see Patent document 2).

Further, instead of personal computers, tablet terminals which may be used in an easier manner have come into common use in recent years.

In the field of sewing machines, a system capable of connecting a sewing machine with a tablet terminal via wireless LAN has been under development.

When editing regarding embroidery is to be performed using a tablet terminal, a personal computer, or the like, a background image is displayed in an embroidery editing screen in order to adjust a sewing position and to confirm an image of finished sewing. For this purpose, the background image is required to be displayed at a correct magnification ratio.

In general, in an application of a personal computer or the like, the background image is converted into image data using a scanner or a digital camera, and the magnification is adjusted by processing the image data. On the other hand, when using a tablet terminal having a camera function, it is conceivable to activate the camera function during an editing operation, and to import an image that has been taken as it is as a background. However, unlike the case using a scanner, in the case of an image taken by a tablet terminal, a standard of dimensions of the image is unclear, and the image may not be displayed at correct magnification ratio. Therefore, it is not possible to use such an image for editing in which the embroidery position and the embroidery range are determined relative to the background image (cloth to be embroidered).

PATENT LITERATURE

[Patent document 1]
Japanese Patent Application Laid-Open No. H8-155163
[Patent document 2]
Japanese Patent Application Laid-Open No. 2004-141471

SUMMARY OF THE INVENTION

One or more embodiments according to the present invention provide an embroidery pattern placement system and an embroidery pattern placement device, with which placement of an embroidery pattern to cloth to be embroidered may be performed in a simple and correct manner, as well as a method of placing an embroidery pattern for such a embroidery pattern placement device, and a sewing machine.

Embodiment 1: one or more embodiments according to the present invention provide an embroidery pattern placement system including: an image-taking unit configured to take an image with an embroidery frame and cloth to be embroidered attached to the embroidery frame included in an image taking range; an embroidery frame information obtaining unit configured to obtain information of the embroidery frame; an image analyzing unit configured to analyze to make correspondence between the information of the embroidery frame obtained by the embroidery frame information obtaining unit and the embroidery frame in the image taken by the image-taking unit; an embroidery pattern obtaining unit configured to obtain information relating to the embroidery pattern to be embroidered; a display control unit configured to display the embroidery pattern obtained by the embroidery pattern obtaining unit and at least a part of the image taken by the image-taking unit in an overlapping manner at an identical scale in a display unit, using the analysis result by the image analyzing unit; an operation unit configured to accept an operation from a user; an embroidery placement editing unit configured to determine a position and orientation of the embroidery pattern relative to the embroidery frame according to a content of the operation to the operation unit; and an embroidery execution unit configured to execute embroidery to the cloth to be embroidered attached to the embroidery frame such that the embroidery corresponds to the position and the orientation of the embroidery pattern determined by the embroidery placement editing unit.

Embodiment 2: one or more embodiments according to the present invention provide an embroidery pattern placement device including: an image-taking unit configured to take an image with an embroidery frame and cloth to be embroidered attached to the embroidery frame included in an image taking range; an embroidery frame information obtaining unit configured to obtain information of the embroidery frame; an image analyzing unit configured to analyze to make correspondence between the information of the embroidery frame obtained by the embroidery frame information obtaining unit and the embroidery frame in the image taken by the image-taking unit; an embroidery pattern obtaining unit configured to obtain information relating to the embroidery pattern to be embroidered; a display control unit configured to display the embroidery pattern obtained by the embroidery pattern obtaining unit and at least a part of the image taken by the image-taking unit in an overlapping manner at an identical scale in a display unit, using the analysis result by the image analyzing unit; an operation unit configured to accept an operation from a user; an embroidery placement editing unit configured to determine a position and orientation of the embroidery pattern relative to the embroidery frame according to a content of the operation to the operation unit; and an embroidery placement information storage unit configured to store information relating to the position and the orientation of the embroidery pattern determined by the embroidery placement editing unit.

Embodiment 3: one or more embodiments according to the present invention provide the embroidery pattern placement device according to embodiment 2, wherein the image-taking unit performs a display corresponding to the embroidery frame in the information of the embroidery frame obtained by the embroidery frame information obtaining unit in the display unit, and whereby guides the user to take an image while the display corresponding to the embroidery frame and the embroidery frame match, and the image analyzing unit makes correspondence between the information of the embroidery frame and the embroidery frame in the taken image, based on a result of the image taking by the image-taking unit performed while the display corresponding to the embroidery frame and the embroidery frame match.

Embodiment 4: one or more embodiments according to the present invention provide the embroidery pattern placement device according to embodiment 2, wherein before the image taking by the image-taking unit, the embroidery frame information obtaining unit obtains the information of the embroidery frame corresponding to a type of the embroidery frame selected by the user using the operation unit.

Embodiment 5: one or more embodiments according to the present invention provide the embroidery pattern placement device according to embodiment 2, wherein the embroidery frame information obtaining unit specifies a type of the embroidery frame to be used in embroidery from the image taken by the image-taking unit, and obtains the information of the embroidery frame corresponding to the specified type of the embroidery frame.

Embodiment 6: one or more embodiments according to the present invention provide the embroidery pattern placement device according to embodiment 2, wherein the embroidery pattern obtaining unit communicates with a sewing machine that is to execute embroidery, and obtains the information relating to the embroidery pattern to be embroidered from the sewing machine.

Embodiment 7: one or more embodiments according to the present invention provide the embroidery pattern placement device according to embodiment 2, including: an embroidery placement information transmission unit configured to transmit embroidery placement information stored in the embroidery placement information storage unit to a sewing machine.

Embodiment 8: one or more embodiments according to the present invention provide the embroidery pattern placement device according to embodiment 2, wherein the embroidery placement editing unit allows changing of a size of the embroidery pattern according to the content of the operation to the operation unit.

Embodiment 9: one or more embodiments according to the present invention provide a method of placing an embroidery pattern of an embroidery pattern placement device, the method including the steps of: taking, by an image-taking unit, an image with an embroidery frame and cloth to be embroidered attached to the embroidery frame included in an image taking range; obtaining, by an embroidery frame information obtaining unit, information of the embroidery frame; analyzing, by an image analyzing unit, to make correspondence between the information of the embroidery frame obtained by the embroidery frame information obtaining unit and the embroidery frame in the image taken by the image-taking unit; obtaining, by an embroidery pattern obtaining unit, information relating to the embroidery pattern to be embroidered; displaying, by a display control unit, the embroidery pattern obtained by the embroidery pattern obtaining unit and at least a part of the image taken by the image-taking unit in an overlapping manner at an identical scale in a display unit, using the analysis result by the image analyzing unit; accepting, by an operation unit, an operation from a user; determining, by an embroidery placement editing unit, a position and orientation of the embroidery pattern relative to the embroidery frame according to a content of the operation to the operation unit; and storing, by an embroidery placement information storage unit, information relating to the position and the orientation of the embroidery pattern determined by the embroidery placement editing unit.

Embodiment 10: one or more embodiments according to the present invention provide a sewing machine including: a communication unit capable of communicating with the embroidery pattern placement device as defined in embodiment 7; and an embroidery execution unit configured to execute embroidery according to embroidery placement information obtained from the embroidery placement information transmission unit via the communication unit.

Embodiment 11: one or more embodiments according to the present invention provide the sewing machine according to embodiment 10, including: an embroidery frame recognition unit configured to recognize a type of an embroidery frame attached to the sewing machine; and an execution determination unit configured to determine whether or not to execute embroidery, wherein the execution determination unit determines to execute embroidery when a type of the embroidery frame included in the embroidery placement information obtained via the communication unit from the embroidery placement information transmission unit matches the type of the embroidery frame recognized by the embroidery frame recognition unit.

One or more embodiments according to the present invention allows placement of an embroidery pattern to cloth to be embroidered in a simple and correct manner.

DETAILED DESCRIPTION

Hereinafter, embodiments for implementing the present invention will be described with reference to the drawings.

Figure 1:
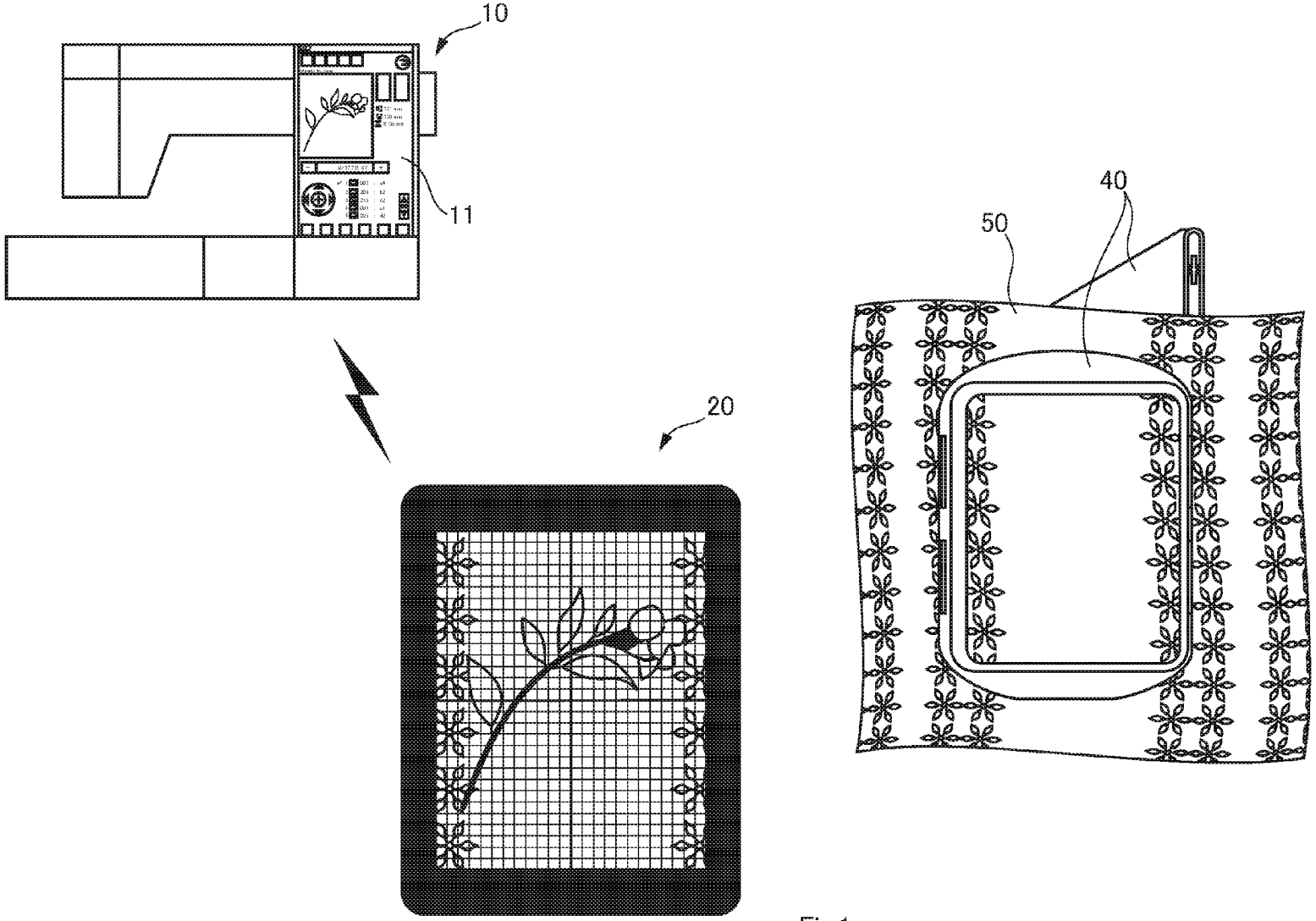
FIG. 1 is a view illustrating an embroidery pattern placement system of an embodiment according to the present invention.

FIG. 1 is a view illustrating an embroidery pattern placement system of an embodiment according to the present invention.

Figure 2:
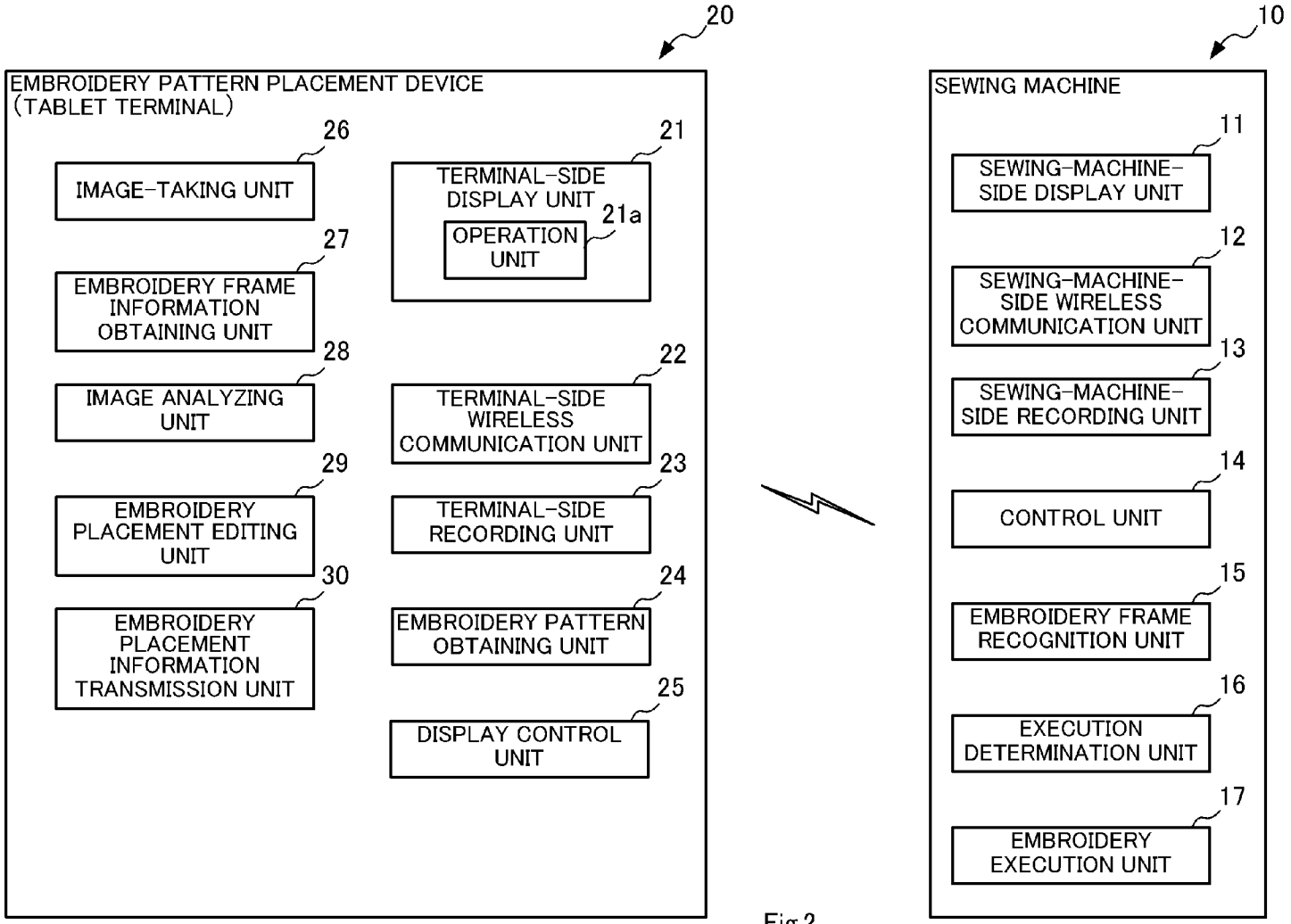
FIG. 2 is a block diagram illustrating a control configuration of a sewing machine 10 and a tablet terminal 20.

FIG. 2 is a block diagram illustrating a control configuration of a sewing machine 10 and a tablet terminal 20.

Figure 3:
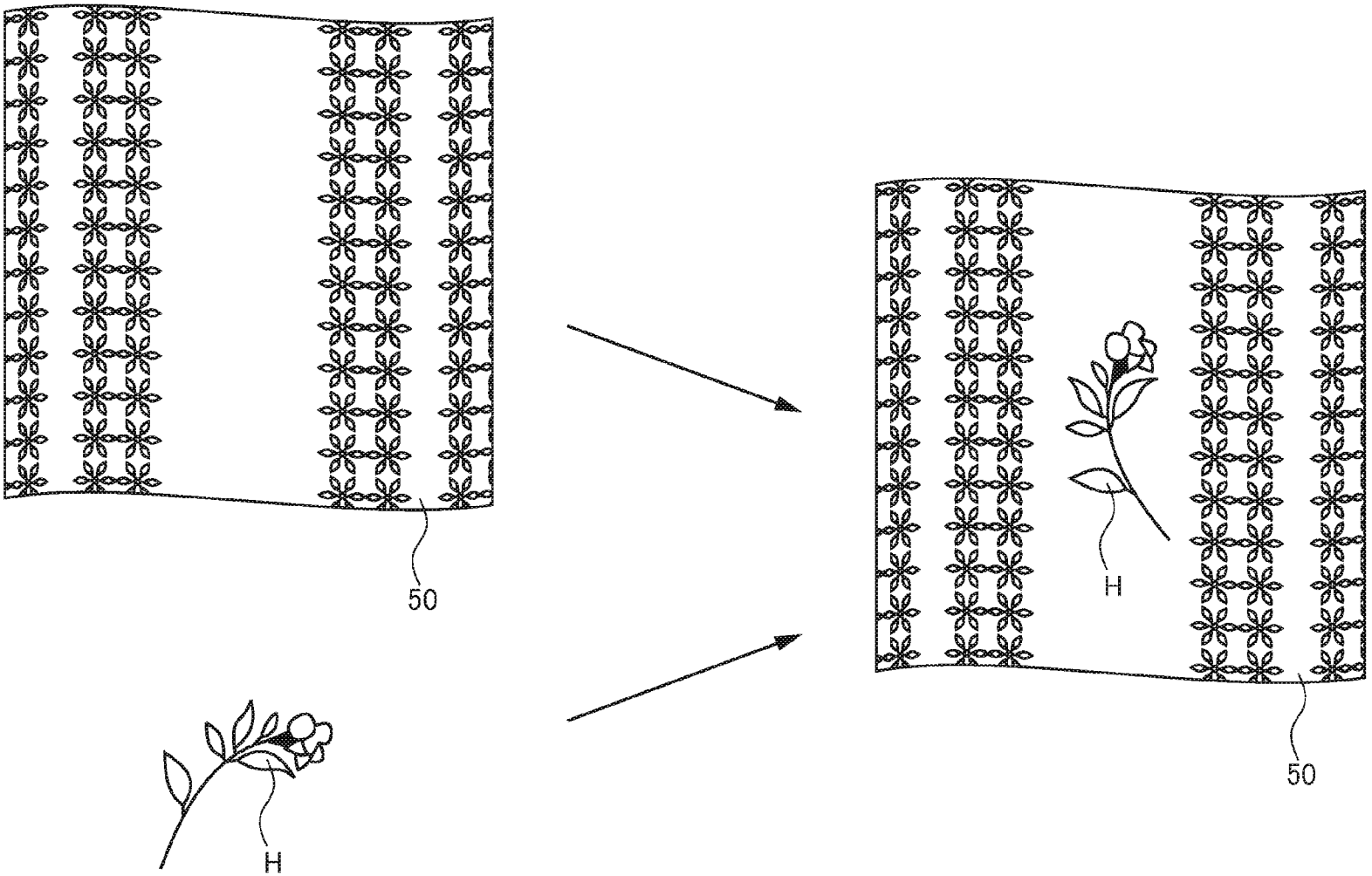
FIG. 3 is a view schematically illustrating placement of an embroidery pattern by the embroidery pattern placement system.

FIG. 3 is a view schematically illustrating placement of an embroidery pattern by the embroidery pattern placement system.

The following figures including FIG. 1 and FIG. 2 are schematic diagrams, in which sizes and shapes of components are shown figuratively if appropriate in order to facilitate understanding.

Further, while specific values, shapes, operations, and the like are referred in the following description, these are mere examples and may be modified as appropriate.

The embroidery pattern placement system according to this embodiment includes the sewing machine 10, and the tablet terminal 20 as an embroidery pattern placement device. The sewing machine 10 and the tablet terminal 20 are able to communicate with each other through a wireless LAN via a router or the like (not shown).

This embodiment describes a case in which an embroidery pattern H is roughly placed on cloth 50 to be embroidered having a pattern as illustrated in FIG. 3 at a position and in a rotational direction (orientation) that a user thinks appropriate, and an embroidery result as illustrated on the right side in FIG. 3 is obtained.

The sewing machine 10 is able to perform embroidery semi-automatically according to embroidery data, using threads of a plurality of colors, for example. The sewing machine 10 is a multi-functional sewing machine capable of performing normal sewing with various sewing patterns.

In the following description, a pattern contained in the embroidery data is referred to as an "embroidery pattern", and the "embroidery data" and the "embroidery pattern" are related to the same pattern.

The sewing machine 10 includes a sewing-machine-side display unit 11, a sewing-machine-side wireless communication unit 12, a sewing-machine-side recording unit 13, a control unit 14, an embroidery frame recognition unit 15, an execution determination unit 16, and an embroidery execution unit 17.

The sewing-machine-side display unit 11 is provided for the sewing machine 10 itself, and configured by a liquid crystal display device, for example. In the sewing-machine-side display unit 11, a variety of information useful for a user is displayed according to an operational status of the sewing machine. For example, in a state in which needle threading is performed, information that may help needle threading operation is displayed. As the sewing machine is multi-functional, the content that is displayed has a number of variations. Further, the sewing-machine-side display unit 11 is configured as a touch panel, and is able to accept various operational inputs by the user.

The sewing-machine-side wireless communication unit 12 is connected to the wireless LAN, and is able to perform wireless communication mutually with the tablet terminal 20 via a router or the like (not shown).

The sewing-machine-side recording unit 13 is configured by a ROM, a RAM, a flash memory, or the like, and records embroidery data of hundreds of patterns, for example.

Further, in addition to the patterns (embroidery data) that are previously stored in the sewing machine 10, the sewing-machine-side recording unit 13 may record patterns that the user externally obtains (user-generated patterns).

The embroidery data itself recorded in the sewing-machine-side recording unit 13, or information related to the embroidery data, may be transferred to the tablet terminal 20.

The control unit 14 controls operation of the sewing machine 10 as a whole. The control unit 14 also makes a response to an inquiry from the tablet terminal 20. Further, using a display function and an input function of the sewing-machine-side display unit 11, the control unit 14 is able to control to allow the sewing machine 10 to alone perform a simple editing operation such as selecting a pattern, combining patterns, or changing a shape of a pattern.

The embroidery frame recognition unit 15 recognizes a type of an embroidery frame 40 attached to the sewing machine 10. The embroidery frame recognition unit 15 of this embodiment recognizes the type of the embroidery frame 40 input or selected by the user using the sewing-machine-side display unit 11 as the type of the embroidery frame 40 attached to the sewing machine 10. The method of recognizing an embroidery frame by the embroidery frame recognition unit 15 is not limited to the above example, and the type of the embroidery frame 40 attached to the sewing machine 10 may be recognized using, for example, an IC chip or a contact network.

The execution determination unit 16 determines whether or not to execute embroidery. More specifically, the execution determination unit 16 determines that embroidery is to be executed when a type of the embroidery frame 40 contained in embroidery placement information obtained via the sewing-machine-side wireless communication unit 12 from an embroidery placement information transmission unit 30 that will be later described matches the type of the embroidery frame 40 recognized by the embroidery frame recognition unit 15.

If the execution determination unit 16 has determined that embroidery is to be executed, the embroidery execution unit 17 executes embroidery on the cloth 50 to be embroidered attached to the embroidery frame 40 according to the embroidery placement information obtained via the sewing-machine-side wireless communication unit 12 from the embroidery placement information transmission unit 30. With this, the embroidery execution unit 17 is able to execute embroidery on the cloth 50 to be embroidered attached to the embroidery frame 40 such that the embroidered pattern corresponds to a position and orientation of an embroidery pattern determined by an embroidery placement editing unit 29 that will be later described.

As the tablet terminal 20, a general-purpose product that is commonly available in the market may be used. In order to use the tablet terminal 20 as an embroidery pattern placement device according to this embodiment, a program for the embroidery pattern placement system (application program) is installed in the tablet terminal 20 and executed. This program may be recorded in a recording medium such as a flash memory device, or may be downloaded through various known networks.

The tablet terminal 20 includes a terminal-side display unit 21, a terminal-side wireless communication unit 22, a terminal-side recording unit 23, an embroidery pattern obtaining unit 24, a display control unit 25, an image-taking unit 26, an embroidery frame information obtaining unit 27, an image analyzing unit 28, the embroidery placement editing unit 29, and the embroidery placement information transmission unit 30.

The terminal-side display unit 21 includes an operation unit 21*a* to function as a touch panel, and is able to accept various operational inputs by the user in addition display of information.

The terminal-side wireless communication unit 22 is connected to the wireless LAN, and is able to perform wireless communication mutually with the sewing machine 10 via a router or the like (not shown).

The terminal-side recording unit 23 is configured by a ROM, a RAM, a flash memory, or the like, and records embroidery data obtained from the sewing machine 10. Immediately after the program for this system is installed in the tablet terminal 20, the terminal-side recording unit 23 may not record any embroidery data, or may record embroidery data for a plurality of patterns.

Further, the terminal-side recording unit 23 also functions as an embroidery placement information storage unit for storing information relating to the position and the orientation of the embroidery pattern determined by the embroidery placement editing unit 29.

The embroidery pattern obtaining unit 24 obtains information relating to the embroidery pattern to be embroidered from the sewing machine 10. More specifically, the embroidery pattern obtaining unit 24 obtains either embroidery data on which sewing is prepared on the side of the sewing machine 10 or information specifying this embroidery data via wireless communication. The embroidery pattern obtaining unit 24 obtains information as to which piece of the embroidery data is to be used when the corresponding embroidery data is recorded in the terminal-side recording unit 23, and obtains the embroidery data itself from the sewing machine 10 when the corresponding embroidery data is not recorded in when the terminal-side recording unit 23.

The display control unit 25 controls display in the terminal-side display unit 21. Further, using an analysis result by the image analyzing unit 28, the display control unit 25 controls to display an embroidery pattern obtained by the embroidery pattern obtaining unit 24 and at least a part of an image taken by the image-taking unit 26 in an overlapping manner at the same scale in the display unit.

The image-taking unit 26 takes an image including the embroidery frame 40 and the cloth 50 to be embroidered attached to the embroidery frame 40 within an image taking range. In practice, an image is taken by the tablet terminal 20 held by the user at hand. Therefore, if everything is left to a person who takes an image, a size of the cloth 50 to be embroidered that has been taken becomes unclear. In this case, it is not possible to make correspondence between the taken range and an actual dimension. In order to avoid such a situation and to make correspondence between the taken range and the actual dimension, the image-taking unit 26 of this embodiment performs an image taking guidance as described below.

Based on information of the embroidery frame 40 obtained by the embroidery frame information obtaining unit 27 that will be later described, the image-taking unit 26 causes the terminal-side display unit 21 to display an image corresponding to the embroidery frame 40 (hereinafter referred to as a frame image), and to guide the user to take an image so as to match the frame image and the embroidery frame 40. Further, the frame image is displayed in a transparent (semi-transparent) manner, so that the frame image can be seen overlapping the image of the image-taking range shown by a camera unit (not shown) of the image-taking unit 26 on a real-time basis (see FIG. 8). With this, the user is easily able to take an image by correctly matching the frame image displayed in the transparent manner and the actual embroidery frame 40 taken by the camera unit.

Figure 7:
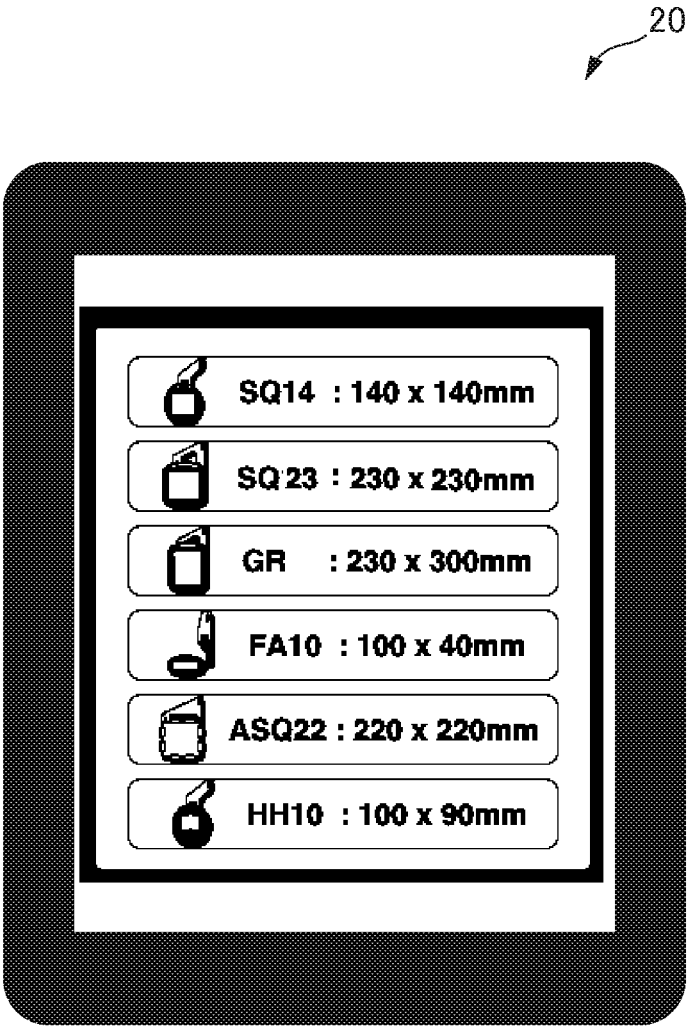
FIG. 7 is a view illustrating a display example of a terminal-side display unit 21 in S1.

The embroidery frame information obtaining unit 27 obtains information of the embroidery frame 40 to be used for embroidery. In this embodiment, before the image-taking unit 26 takes an image, the embroidery frame information obtaining unit 27 obtains information of the embroidery frame 40, for example, according to the type of the embroidery frame 40 selected by the user using the terminal-side display unit 21 in which a display as illustrated in FIG. 7 is shown.

The image analyzing unit 28 analyzes to make correspondence between the information of the embroidery frame 40 obtained by the embroidery frame information obtaining unit 27 and the embroidery frame 40 in the image taken by the image-taking unit 26. More specifically, the image analyzing unit 28 makes correspondence between the information of the embroidery frame 40 and the embroidery frame 40 in the image on the assumption that the image-taking unit 26 takes the image having the embroidery frame 40 matching the frame image. If the frame image and the embroidery frame 40 in the image match and overlap, it is possible to make correspondence between the taken image and the actual dimension as the size of the embroidery frame 40 is known from the information of the embroidery frame 40 obtained by the embroidery frame information obtaining unit 27.

The embroidery placement editing unit 29 determines the position and the orientation of the embroidery pattern relative to the embroidery frame 40 according to an operation to the terminal-side display unit 21 by the operation unit 21*a*. For example, the embroidery placement editing unit 29 is able to change the size of the embroidery pattern and the rotational position (orientation) of the embroidery position according to a content of the operation by the operation unit 21*a*.

The embroidery placement information transmission unit 30 transmits the embroidery placement information recorded in the terminal-side recording unit 23 to the sewing machine 10. Thus, the sewing machine 10 is able to execute the embroidery based on the embroidery data that has been edited on the tablet terminal 20 by the embroidery placement editing unit 29.

Next, a method of synchronizing the embroidery data for the embroidery pattern placement system according to this embodiment is described with reference to flowcharts.

Figure 4:
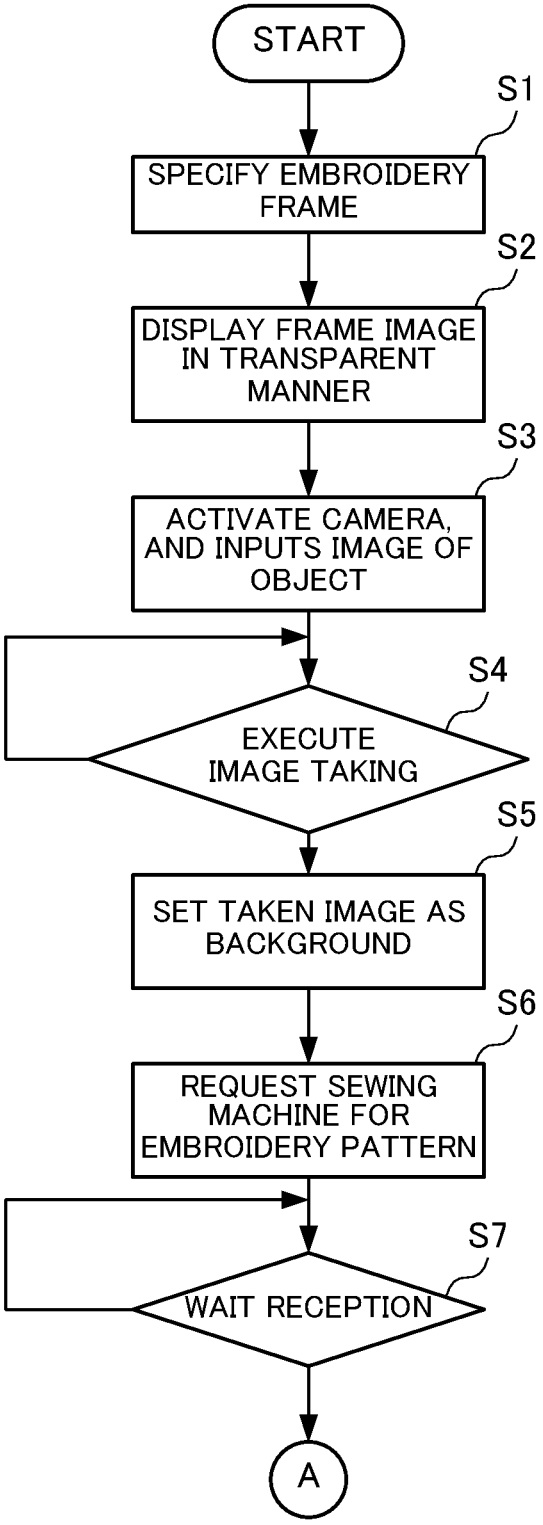
FIG. 4 is a flowchart showing a flow of a placement operation of the embroidery pattern by the embroidery pattern placement system.
Figure 5:
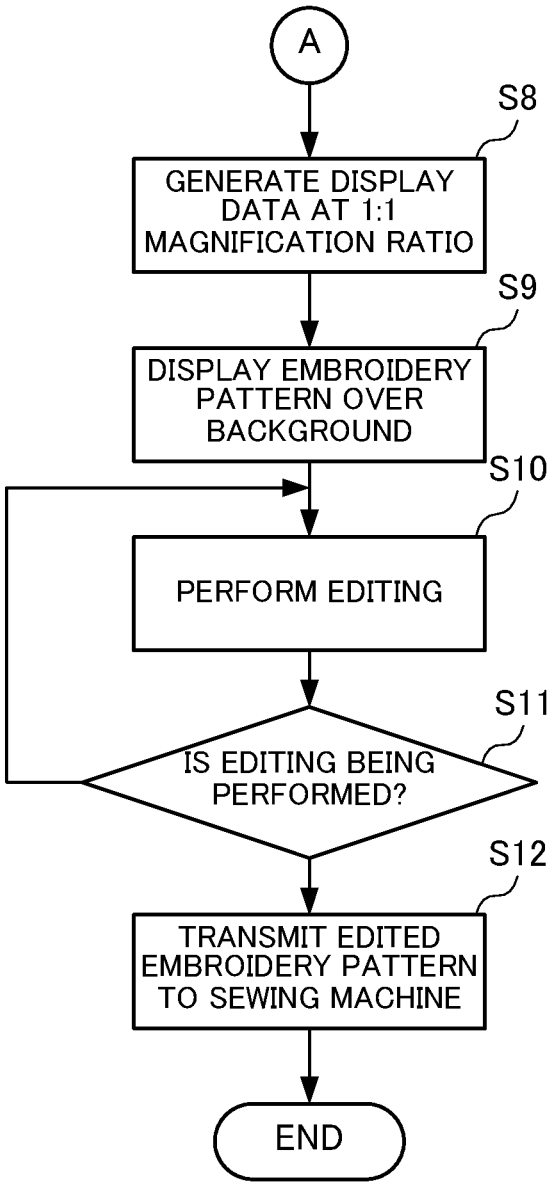
FIG. 5 is a flowchart showing a flow of the placement operation of the embroidery pattern by the embroidery pattern placement system.

FIG. 4 and FIG. 5 are flowcharts for a flow of an operation of placing the embroidery pattern by the embroidery pattern placement system.

Here, the sewing machine 10 and the tablet terminal 20 are connected via a router (not shown), and are able to communicate with each other through a wireless LAN by previously having cryptosystems match and setting a password on either side.

Figure 6:
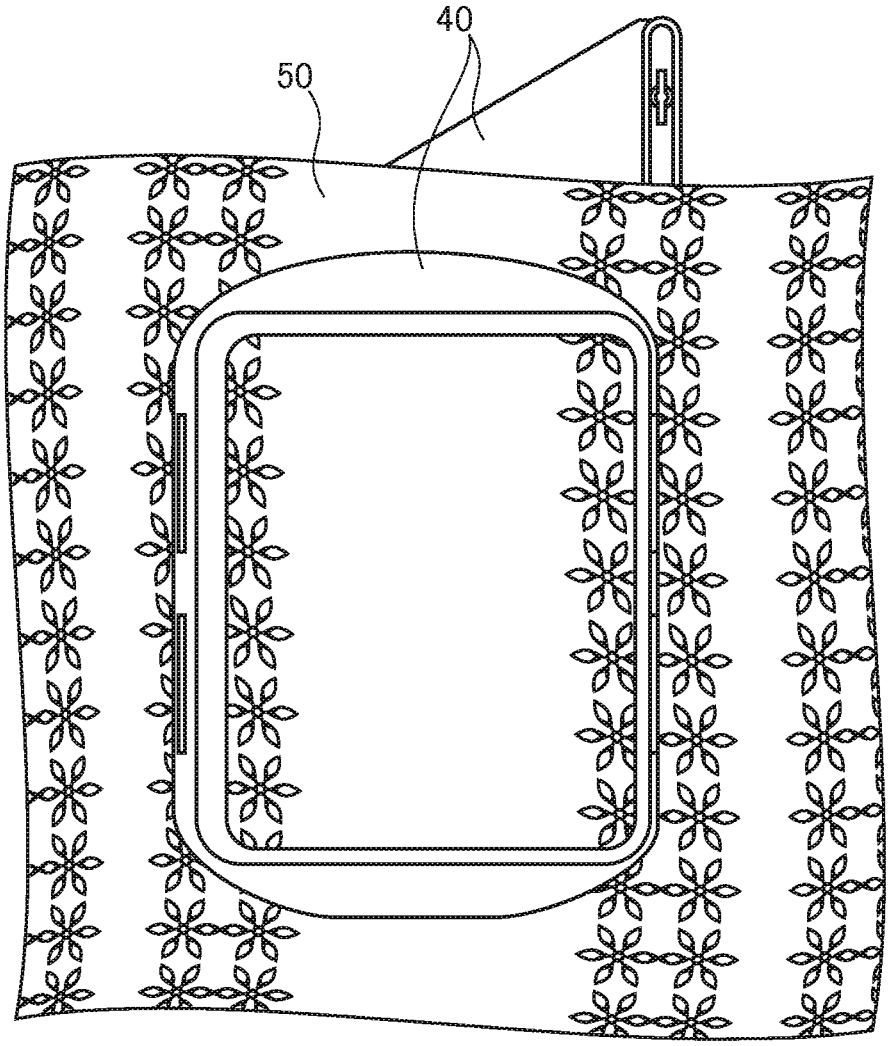
FIG. 6 is a view illustrating cloth 50 to be embroidered being attached to an embroidery frame 40.

FIG. 6 is a view illustrating the cloth 50 to be embroidered being attached to the embroidery frame 40.

Before operating the tablet terminal 20, the cloth 50 to be embroidered is previously attached to the embroidery frame 40 as illustrated in FIG. 6.

Upon activation of an embroidery editing application of the tablet terminal 20, in Step (hereinafter simply referred to as S) 1, the embroidery frame information obtaining unit 27 requests the user to specify a type of the embroidery frame 40 to which the cloth 50 to be embroidered is attached.

FIG. 7 is a view illustrating a display example of the terminal-side display unit 21 in S1.

For example, the embroidery frame information obtaining unit 27 displays a list as illustrated in FIG. 7, and specifies the type of the embroidery frame 40 selected by the user among the list as the embroidery frame 40 to be used in embroidery. Here, the following description is given assuming that a frame type GR is selected.

Data such as the size of each type of the embroidery frame 40 is stored in the terminal-side recording unit 23, but may be obtained through communication with the sewing machine 10, or a server or the like connected to a network.

In S2, the image-taking unit 26 displays a frame image of the embroidery frame 40 that has been selected in S1 such that its background is transparent.

Figure 8:
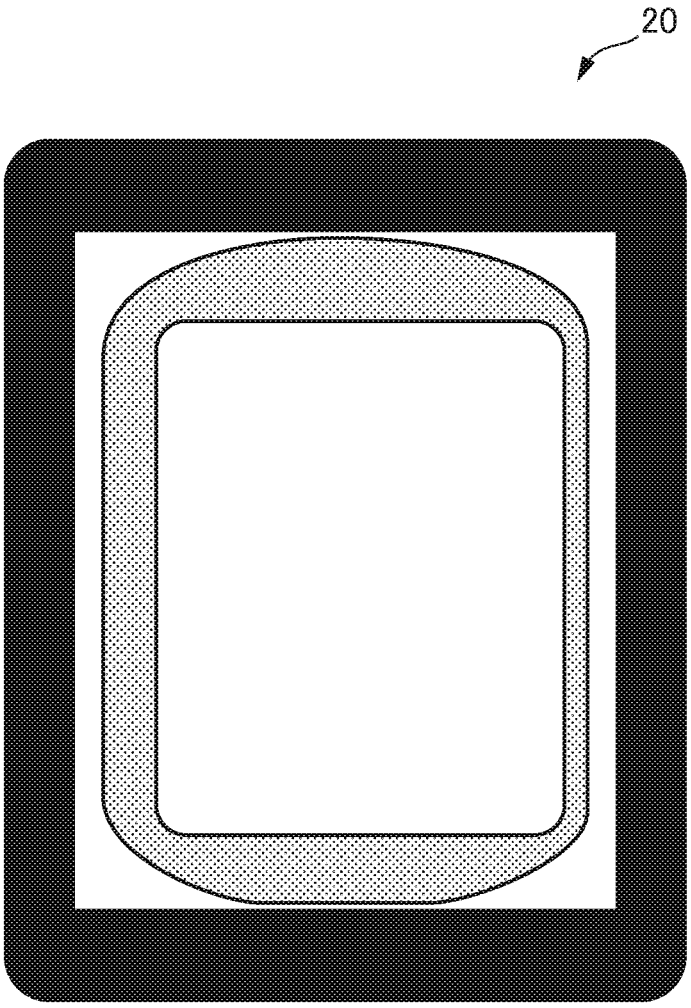
FIG. 8 is a view illustrating a display example of a frame image.

FIG. 8 is a view illustrating a display example of the frame image.

In the case of the frame type GR, for example, an effective embroidery range is in a size of 230 mm×300 mm. Assuming that the tablet terminal 20 whose display resolution is 264 dpi with a display of 1563 dots×2048 dots is used, and that an area of 1000 dots×1300 dots out of this display corresponds to an embroidery range, drawing at 0.23 mm per dot is sufficient.

In S3, a camera function of the tablet terminal 20 is activated, and an image input from the camera unit is shown in the screen. The user adjusts an image taking range so that the frame image displayed in the transparent manner and an outline of the embroidery frame 40 to which the cloth 50 to be embroidered is set and shown through the camera match and overlap with each other. The adjustment of the image taking range may be performed by adjusting a position of the camera (a position of the tablet terminal 20), or may be performed using a zooming function if the camera unit has this function.

Figure 9:
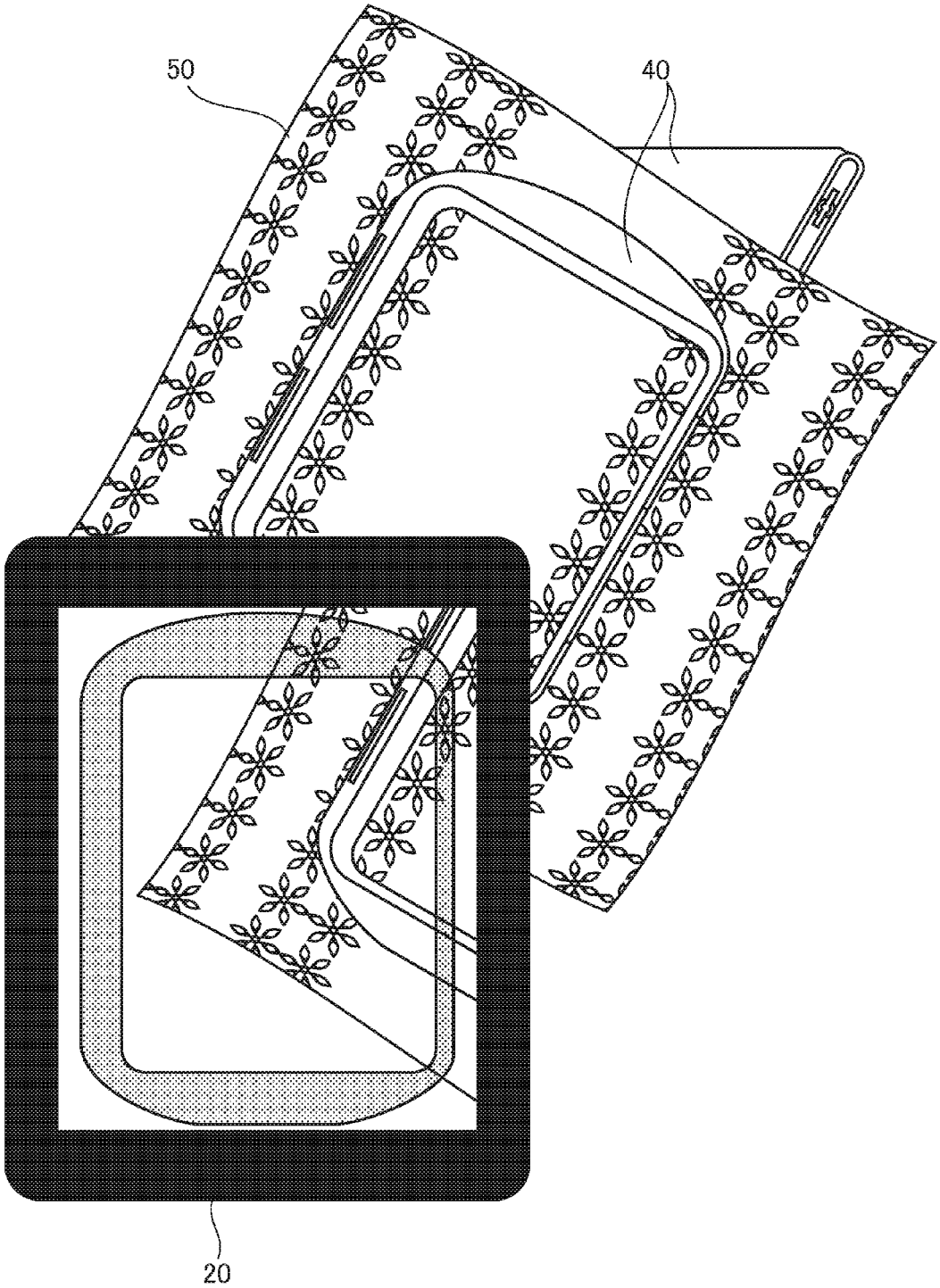
FIG. 9 is a view illustrating a state in which a frame image is displaced from the embroidery frame 40 shown through a camera, to which the cloth 50 to be embroidered is set.

FIG. 9 is a view illustrating a state in which the frame image is displaced from the outline of the embroidery frame 40 to which the cloth 50 to be embroidered is set and shown through the camera.

Figure 10:
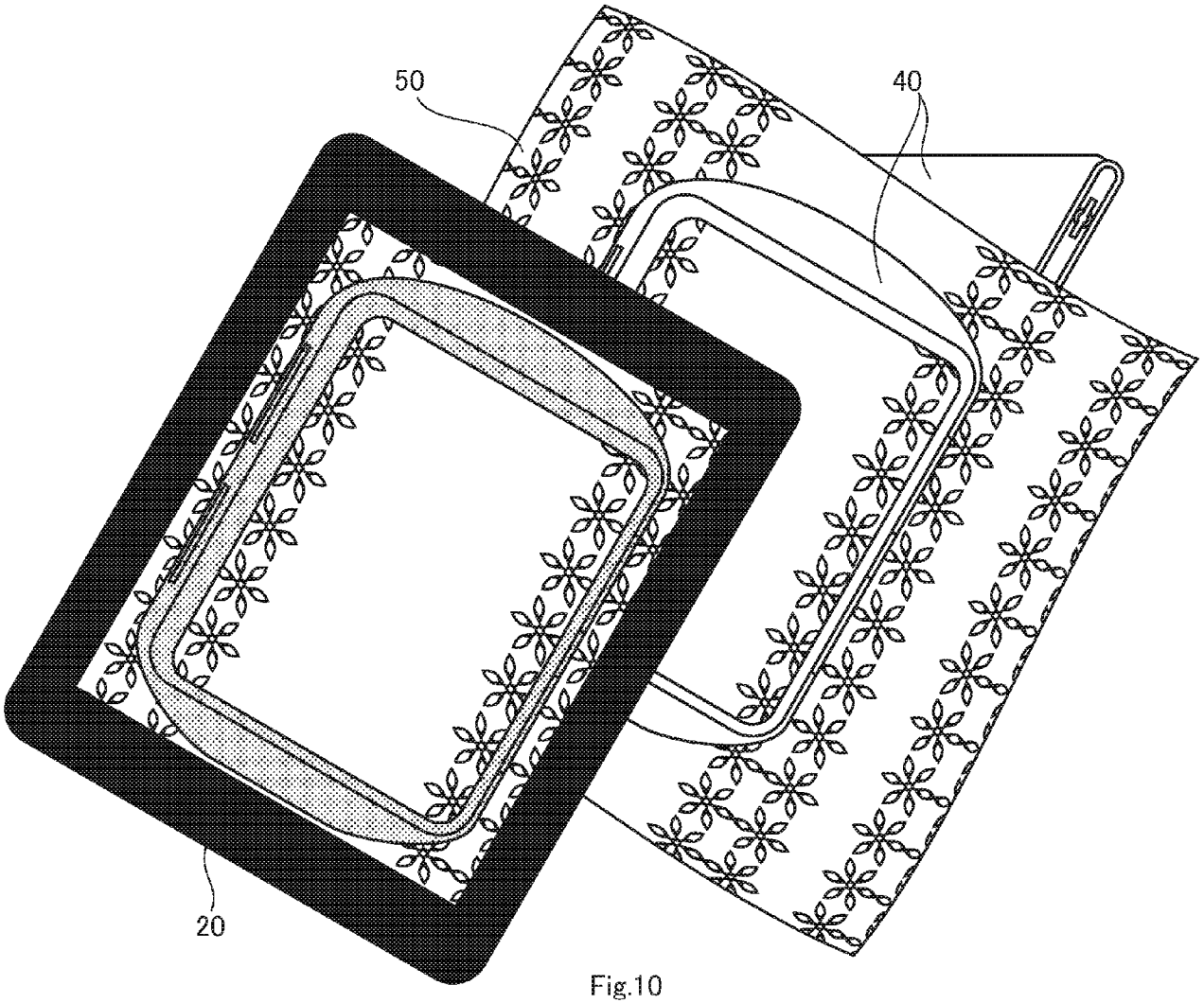
FIG. 10 is a view illustrating a state in which a frame image matches the embroidery frame 40 shown through the camera, to which the cloth 50 to be embroidered is set.

FIG. 10 is a view illustrating a state in which the frame image match the outline of the embroidery frame 40 to which the cloth 50 to be embroidered is set and shown through the camera.

The user adjusts the image taking range in S3 such that the state as illustrated in FIG. 9 becomes the state as illustrated in FIG. 10.

In S4, the image-taking unit 26 executes image taking by the user's operation. Here, the image taking may be performed automatically based on image recognition when the frame image matches the outline of the embroidery frame to which the cloth to be embroidered is set and shown through the camera.

In S5, the image analyzing unit 28 performs an analysis to make correspondence between the information of the embroidery frame 40 obtained in S1 and the embroidery frame 40 in the image taken in S4. As the background image is taken at the same size as the frame image, similarly to the frame image described above, an analysis result is easily obtained as drawing at 0.23 mm per dot is sufficient. Then, the image data of the embroidery frame 40 to which the cloth 50 to be embroidered is set is recorded in the terminal-side recording unit 23 as a background image for the editing screen.

In S6, the embroidery pattern obtaining unit 24 transmits a pattern data requesting command to the sewing machine 10 through the wireless LAN. Here, it is assumed that an embroidery pattern to be used in embroidery has previously been selected on the side of the sewing machine 10. However, if an embroidery pattern has not been selected, it is possible to perform processing to prompt the selection of an embroidery pattern in S6.

In S7, the embroidery pattern obtaining unit 24 waits completion of reception of the embroidery data transmitted from the sewing machine 10. Upon completion of reception of the embroidery data, the received embroidery data is stored in a temporary recording area of the terminal-side recording unit 23, and the operation moves to S8.

In S8, the embroidery placement editing unit 29 generates drawing (display) data for the embroidery pattern, based on the embroidery data received in S7. For example, in a case of a 100 mm×100 mm embroidery pattern, drawing the embroidery pattern in 435 dots×435 dots (100 mm/0.23 mm=435 dots) allows drawing of the embroidery pattern at a magnification ratio equal to that of the embroidery frame 40 to which the cloth 50 to be embroidered is set or the pattern of the cloth 50 to be embroidered (at 1:1 magnification ratio).

In S9, the display control unit 25 displays the embroidery pattern that has been received from the sewing machine 10 over the image of the cloth 50 to be embroidered that has been taken as a background. Specifically, as described above, using the analysis result by the image analyzing unit 28 in S5, the display control unit 25 controls such that the embroidery pattern obtained by the embroidery pattern obtaining unit 24 and at least a part of the image taken by the image-taking unit 26 are displayed in an overlapping manner at the same scale in the display unit.

Figure 11:
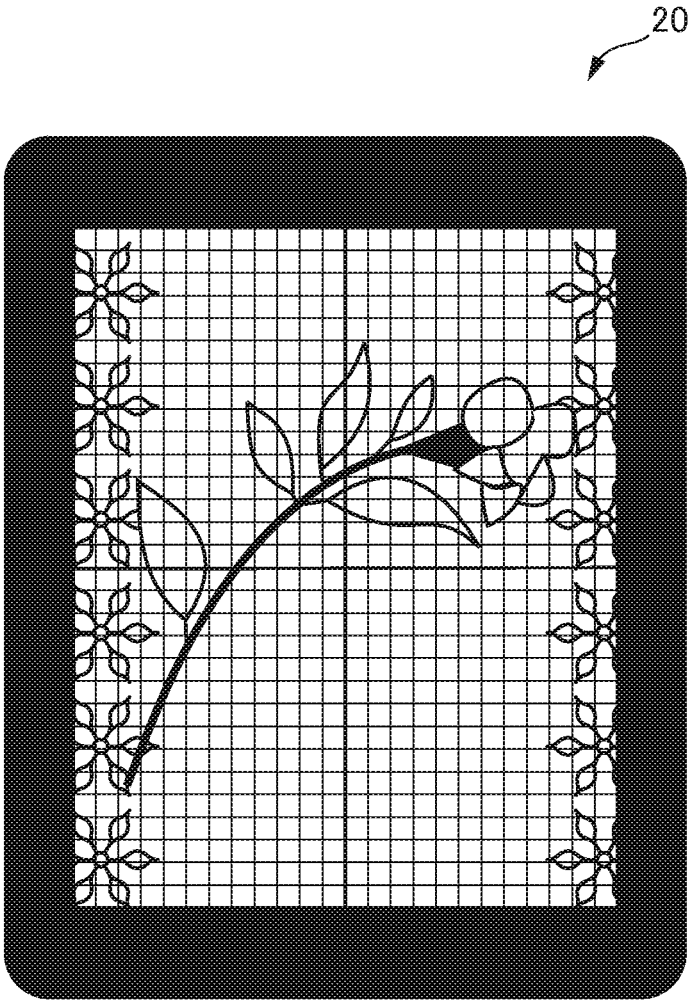
FIG. 11 is a view illustrating a display example in which a terminal-side display unit 21 displays a background image that has been taken along with an embroidery pattern that has been received at the same magnification ratio.

FIG. 11 is a view illustrating a display example in which the terminal-side display unit 21 displays the background image that has been taken along with the embroidery pattern that has been received at the same magnification ratio.

While the outline of the embroidery frame 40 is also displayed when taking the embroidery frame 40 to which the cloth 50 to be embroidered is set, the display is further enlarged as only the embroidery range is displayed to full screen of the terminal-side display unit 21 in the editing screen as illustrated in FIG. 11.

In S10, the embroidery placement editing unit 29 accepts an editing operation of the embroidery pattern from the user.

Figure 12:
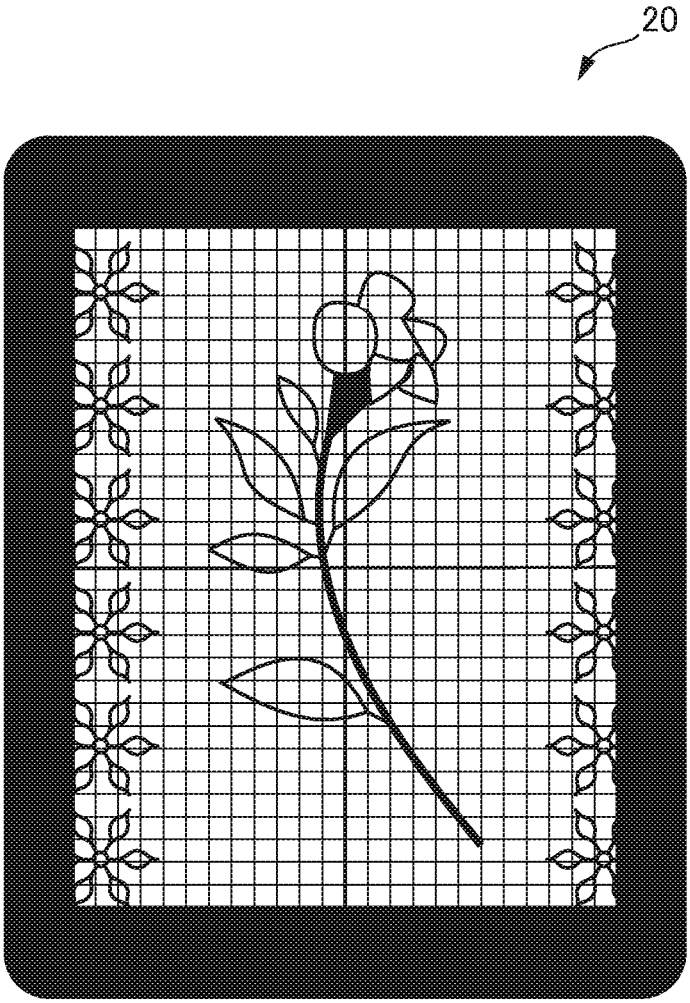
FIG. 12 is a view illustrating a state in which the embroidery pattern is rotated by an editing operation by a user.

FIG. 12 is a view illustrating a state in which the embroidery pattern is rotated by the editing operation by the user.

In the editing operation of the embroidery pattern, as illustrated in FIG. 12, for example, the embroidery pattern is rotated so as not to interfere with the pattern in the background, and then the position and the orientation of the embroidery pattern is determined. As the editing operation by the embroidery placement editing unit 29, in addition to changing of the position and the orientation of the embroidery pattern, enlarging or contracting of the embroidery pattern (size change) may be performed.

In this embodiment, the editing operation may be performed while taking the image data of the cloth 50 to be embroidered attached to the embroidery frame 40 as the background, and looking at the embroidery pattern at the same magnification ratio as the cloth 50 to be embroidered in the image data. Therefore, it is possible to easily perform editing while correctly adjusting a relation between the pattern on the cloth 50 to be embroidered and the embroidery pattern.

In S11, S10 is repeated until the editing operation is completed. Completion of the editing operation is instructed by an operational input by the user. Upon completion of the editing operation, the operation moves to S12.

In S12, upon completion of the editing operation of the pattern, data file is generated from the edited embroidery pattern in a format of the embroidery data, and transmitted to the sewing machine 10.

Embroidery can be made at a suitable position on the cloth 50 to be embroidered by attaching the embroidery frame 40 to which the cloth 50 to be embroidered is set that has been taken in S4 to the sewing machine 10, and by having the embroidery execution unit 17 perform embroidery using the embroidery placement information received by the sewing machine 10.

At this time, the execution determination unit 16 determines that the embroidery is to be executed and allows execution of embroidery when the type of the embroidery frame 40 included in the embroidery placement information obtained from the embroidery placement information transmission unit 30 matches the type of the embroidery frame 40 recognized by the embroidery frame recognition unit 15.

Figure 13:
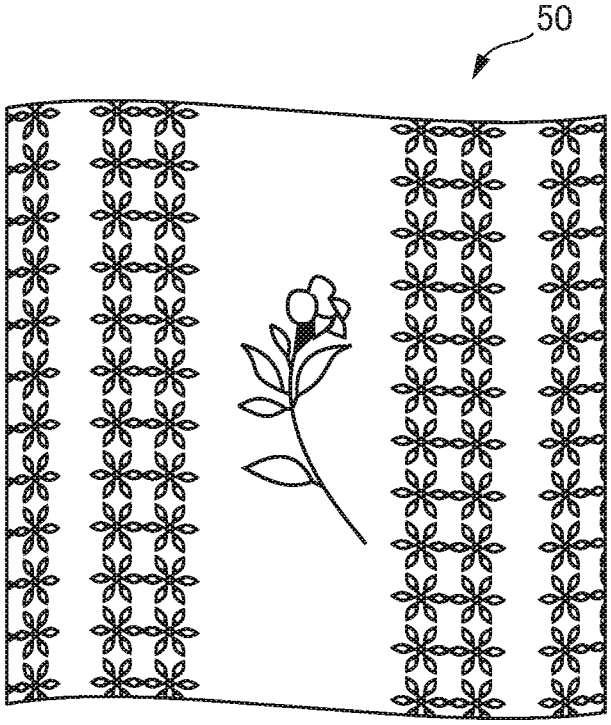
FIG. 13 is a view illustrating the cloth 50 to be embroidered after the embroidery pattern has been edited and the embroidery has been finished.

FIG. 13 is a view illustrating the cloth 50 to be embroidered after the embroidery pattern has been edited and the embroidery has been finished.

As described above, according to this embodiment, it is possible to obtain the background image used in the editing screen and the magnification ratio information at the same time by setting the cloth 50 to be embroidered having a pattern to the embroidery frame 40 whose size is known, and taking an image including the embroidery frame 40.

Further, only by displaying the frame image at the time of image taking, and making the frame image match the embroidery frame 40, it is possible to easily and correctly make correspondence between the image data of the cloth 50 to be embroidered and the information of the embroidery frame 40 (adjustment of the magnification ratio of the image data of the cloth 50 to be embroidered and the embroidery pattern).

Moreover, when the pattern to be embroidered has been selected on the side of the sewing machine 10, the tablet terminal 20 immediately receives the embroidery data for this pattern, and draws a pattern image on the editing screen while maintaining the relation of the magnification ratios at 1:1. Specifically, an image of the pattern of the cloth to be embroidered and the pattern to be embroidered is displayed on the editing screen. Thus, by further adjusting the positions of the pattern or rotating the pattern on the editing screen, and transmitting back to the sewing machine 10 again, it is possible to make embroidery of the embroidery pattern whose positional relation to the pattern is adjusted.

Further, by previously drawing a reference line (e.g., crossed lines) over the cloth 50 to be embroidered, rotational displacement may be also shown through the camera when the embroidery frame 40 is set, and it is possible to easily correct the rotational displacement by adjusting the position and the orientation of the embroidery pattern according to the rotational displacement. This approach is also effective in a case in which a pattern is not included in the embroidery frame 40.

It is possible to realize the embroidery pattern placement device and the method of placing an embroidery pattern for the embroidery pattern placement device according to the present invention by having the process of the tablet terminal 20 be recorded in a computer-readable recording medium, and by having the tablet terminal 20 read and execute a program recorded in the recording medium. As used herein, the computer includes an OS and hardware such as peripheral devices.

Further, when a WWW (World Wide Web) system is used, a web-page providing environment (or display environment) is also included in the "computer". Moreover, the program may be transmitted from the computer having the program stored in a storage device or the like to another computer via a transmission medium or by transmitted waves in the transmission medium. As used herein, the "transmission medium" that transmits the program refers to a medium having a function for transmitting information, like a network (communication network) such as the Internet or a telecommunication line (communication line) such as telephone line.

Furthermore, the program may be for realizing a part of the function described above. In addition, the program may be a so-called difference file (difference program) with which the functions described above may be achieved in combination with a program that is already recorded in the computer.

Modified Embodiment

The present invention is not limited to the embodiment described above, and may be modified or altered in various ways, which are also included within the scope of the present invention.

In this embodiment, the example in which the tablet terminal 20 is used as the embroidery pattern placement device is described. The present invention is not limited to such an example, and a personal computer or a gaming machine may be used as the embroidery pattern placement device, for example. As long as the application program can be executed and communication with the sewing machine 10 is possible, a device of any configuration may be used.

In this embodiment, the example in which the sewing machine 10 and the tablet terminal 20 communicate through a wireless LAN is described. The present invention is not limited to such an example, and it is possible to use a different type of communication such as infrared communication or Bluetooth (registered trademark), for example.

In this embodiment, the example in which the embroidery frame information obtaining unit 27 obtains the information of the embroidery frame 40 according to the type of the embroidery frame 40 selected by the user using the terminal-side display unit 21 before the image taking by the image-taking unit 26 is described. The present invention is not limited to such an example, and the embroidery frame information obtaining unit 27 may specify the type of the embroidery frame 40 to be used in embroidery from the image taken by the image-taking unit 26, and obtain the information of the embroidery frame 40 corresponding to the type of the embroidery frame 40, for example. For example, it is possible to recognize based on a shape of the embroidery frame 40 that has been taken by analyzing the image taken by the image-taking unit 26, or to perform image recognition by displaying a character, a bar code, or the like on the embroidery frame.

In this embodiment, the example in which the image analyzing unit 28 makes correspondence between the information of the embroidery frame 40 and the embroidery frame 40 in the taken image, on the assumption that the image taking by the image-taking unit 26 is performed with the frame image matching the embroidery frame 40, is described. The present invention is not limited to such an example, and it is possible to analyze an image of the embroidery frame 40 in the taken image, to specify the position and the size of the embroidery frame 40 in the taken image, and to make correspondence with the information of the embroidery frame 40 obtained by the embroidery frame information obtaining unit 27, for example. In this case, the frame image is not required to be displayed in the transparent manner in the image taking.

While the embodiment and the modified embodiment may be used in an appropriate combination, detailed descriptions shall be omitted. Further, the present invention is not limited to the embodiments described above.

REFERENCE SIGNS LIST

10: sewing machine
11: sewing-machine-side display unit
12: sewing-machine-side wireless communication unit
13: sewing-machine-side recording unit
14: control unit
15: embroidery frame recognition unit
16: execution determination unit
17: embroidery execution unit
20: tablet terminal
21: terminal-side display unit
21*a*: operation unit
22: terminal-side wireless communication unit
23: terminal-side recording unit
24: embroidery pattern obtaining unit
25: display control unit
26: image-taking unit
27: embroidery frame information obtaining unit
28: image analyzing unit
29: embroidery placement editing unit
30: embroidery placement information transmission unit
40: embroidery frame
50: cloth (to be embroidered)
H: embroidery pattern

What is claimed is:

1. An embroidery pattern placement system comprising:

an image-taking unit that takes an image with an embroidery frame and cloth to be embroidered attached to the embroidery frame included in an image taking range;

an embroidery frame information obtaining unit that obtains information of the embroidery frame;

an image analyzing unit that analyzes a positional relationship between the information of the embroidery frame obtained by the embroidery frame information obtaining unit and the embroidery frame in the image taken by the image-taking unit;

an embroidery pattern obtaining unit that obtains information relating to the embroidery pattern to be embroidered;

a display control unit that displays the embroidery pattern obtained by the embroidery pattern obtaining unit and at least a part of the image taken by the image-taking unit in an overlapping manner at an identical scale in a display unit, using the analysis result by the image analyzing unit;

an operation unit that accepts an operation from a user;

an embroidery placement editing unit that determines a position and orientation of the embroidery pattern relative to the embroidery frame according to a content of the operation to the operation unit; and an embroidery execution unit that executes embroidery to the cloth to be embroidered attached to the embroidery frame such that the embroidery corresponds to the position and the orientation of the embroidery pattern determined by the embroidery placement editing unit, wherein:

the image-taking unit performs a display corresponding to the embroidery frame in the information of the embroidery frame obtained by the embroidery frame information obtaining unit in the display unit, and whereby guides the user to take an image while the display corresponding to the embroidery frame and the embroidery frame match; and the image analyzing unit analyzes the positional relationships between the information of the embroidery frame and the embroidery frame in the taken image, based on a result of the image taking by the image-taking unit performed while the display corresponding to the embroidery frame and the embroidery frame match.

2. An embroidery pattern placement device comprising:

an image-taking unit that takes an image with an embroidery frame and cloth to be embroidered attached to the embroidery frame included in an image taking range;

an embroidery frame information obtaining unit obtain information of the embroidery frame;

an image analyzing unit that analyzes a positional relationship between the information of the embroidery frame obtained by the embroidery frame information obtaining unit and the embroidery frame in the image taken by the image-taking unit;

an embroidery pattern obtaining unit that obtains information relating to the embroidery pattern to be embroidered;

a display control unit that displays the embroidery pattern obtained by the embroidery pattern obtaining unit and at least a part of the image taken by the image-taking unit in an overlapping manner at an identical scale in a display unit, using the analysis result by the image analyzing unit;

an operation unit that accepts an operation from a user;

an embroidery placement editing unit that determines a position and orientation of the embroidery pattern relative to the embroidery frame according to a content of the operation to the operation unit; and an embroidery placement information storage unit that stores information relating to the position and the orientation of the embroidery pattern determined by the embroidery placement editing unit, wherein:

the image-taking unit performs a display corresponding to the embroidery frame in the information of the embroidery frame obtained by the embroidery frame information obtaining unit in the display unit, and whereby guides the user to take an image while the display corresponding to the embroidery frame and the embroidery frame match; and the image analyzing unit analyzes the positional relationships between the information of the embroidery frame and the embroidery frame in the taken image, based on a result of the image taking by the image-taking unit performed while the display corresponding to the embroidery frame and the embroidery frame match.

3. The embroidery pattern placement device according to claim 2, wherein before the image taking by the image-taking unit, the embroidery frame information obtaining unit obtains the information of the embroidery frame corresponding to a type of the embroidery frame selected by the user using the operation unit.

4. The embroidery pattern placement device according to claim 2, wherein the embroidery frame information obtaining unit specifies a type of the embroidery frame to be used in embroidery from the image taken by the image-taking unit, and obtains the information of the embroidery frame corresponding to the specified type of the embroidery frame.

5. The embroidery pattern placement device according to claim 2, wherein the embroidery pattern obtaining unit communicates with a sewing machine that is to execute embroidery, and obtains the information relating to the embroidery pattern to be embroidered from the sewing machine.

6. The embroidery pattern placement device according to claim 2, comprising:

an embroidery placement information transmission unit that transmits embroidery placement information stored in the embroidery placement information storage unit to a sewing machine.

7. The embroidery pattern placement device according to claim 2, wherein the embroidery placement editing unit allows changing of a size of the embroidery pattern according to the content of the operation to the operation unit.

8. A method of placing an embroidery pattern of an embroidery pattern placement device, the method comprising the steps of:

taking, by an image-taking unit, an image with an embroidery frame and cloth to be embroidered attached to the embroidery frame included in an image taking range;

obtaining, by an embroidery frame information obtaining unit, information of the embroidery frame;

analyzing, by an image analyzing unit, a positional relationship between the information of the embroidery frame obtained by the embroidery frame information obtaining unit and the embroidery frame in the image taken by the image-taking unit;

obtaining, by an embroidery pattern obtaining unit, information relating to the embroidery pattern to be embroidered;

displaying, by a display control unit, the embroidery pattern obtained by the embroidery pattern obtaining unit and at least a part of the image taken by the image-taking unit in an overlapping manner at an identical scale in a display unit, using the analysis result by the image analyzing unit;

accepting, by an operation unit, an operation from a user;

determining, by an embroidery placement editing unit, a position and orientation of the embroidery pattern relative to the embroidery frame according to a content of the operation to the operation unit; and storing, by an embroidery placement information storage unit, information relating to the position and the orientation of the embroidery pattern determined by the embroidery placement editing unit, wherein, in the step of taking the image by the image-taking unit, the image-taking unit performs a display corresponding to the embroidery frame in the information of the embroidery frame obtained by the embroidery frame information obtaining unit in the display unit, and whereby guides the user to take an image while the display corresponding to the embroidery frame and the embroidery frame match; and wherein, in the step of analyzing the positional relationship, the image analyzing unit analyzes the positional relationship, based on a result of the image taking by the image-taking unit performed while the display corresponding to the embroidery frame and the embroidery frame match.

9. A sewing machine comprising:

a communication unit that communicates with the embroidery pattern placement device as defined in claim 6; and an embroidery execution unit that executes embroidery according to embroidery placement information obtained from the embroidery placement information transmission unit via the communication unit.

10. The sewing machine according to claim 9, comprising:

an embroidery frame recognition unit that recognizes a type of an embroidery frame attached to the sewing machine; and an execution determination unit that determines whether or not to execute embroidery, wherein the execution determination unit determines to execute embroidery when a type of the embroidery frame included in the embroidery placement information obtained via the communication unit from the embroidery placement information transmission unit matches the type of the embroidery frame recognized by the embroidery frame recognition unit.

* * * * *